US009533822B2

(12) United States Patent
Policicchio

(10) Patent No.: US 9,533,822 B2
(45) Date of Patent: Jan. 3, 2017

(54) KIT FOR FLUFFING A CLEANING IMPLEMENT

(71) Applicant: The Procter & Gamble Company, Cincinnati, OH (US)

(72) Inventor: Nicola John Policicchio, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 336 days.

(21) Appl. No.: 14/169,201

(22) Filed: Jan. 31, 2014

(65) Prior Publication Data

US 2014/0224698 A1 Aug. 14, 2014

Related U.S. Application Data

(60) Provisional application No. 61/762,534, filed on Feb. 8, 2013.

(51) Int. Cl.

| | |
|---|---|
| ***B65D 85/16*** | (2006.01) |
| ***A47L 13/38*** | (2006.01) |
| ***B65D 83/08*** | (2006.01) |

(52) U.S. Cl.

CPC ..... *B65D 85/16* (2013.01); *A47L 13/38* (2013.01); *B65D 83/0805* (2013.01); *B65D 83/0894* (2013.01)

(58) Field of Classification Search

CPC ..... A47K 10/426; A47K 10/44; A47K 10/42; A47L 13/16; A47L 13/17; A47L 13/58; B65D 83/0463; B65D 83/0805; B65D 83/0811; B65D 83/0835; B65D 83/0847; B65D 83/0894; B65D 85/16; B65H 3/58

USPC ..... 206/210, 233, 494; 221/26, 46–49, 63; 15/209.1

See application file for complete search history.

(56) References Cited

U.S. PATENT DOCUMENTS

| | | | | |
|---|---|---|---|---|
| 823,725 | A | 6/1906 | Hayden | |
| 4,145,787 | A | 3/1979 | Bastian | |
| 5,520,308 | A * | 5/1996 | Berg, Jr. | B65D 83/0894 206/233 |
| 5,953,784 | A | 9/1999 | Suzuki et al. | |
| 6,109,430 | A * | 8/2000 | Bando | A47K 10/421 206/494 |
| 6,743,392 | B2 | 6/2004 | Tanaka et al. | |
| 6,813,801 | B2 | 11/2004 | Tanaka et al. | |
| 6,968,591 | B2 | 11/2005 | Tanaka et al. | |
| 6,984,615 | B2 | 1/2006 | Kenmochi et al. | |
| 7,003,856 | B2 | 2/2006 | Hayashi et al. | |

(Continued)

FOREIGN PATENT DOCUMENTS

| | | | |
|---|---|---|---|
| FR | EP 1701602 A1 * | 9/2006 | B65D 19/44 |
| JP | A-2004-305240 A | 11/2004 | |

OTHER PUBLICATIONS

Toallitas Limpiadoras de Banos; Package enclosed.
Multi-Purpose Wipes; Package enclosed.

*Primary Examiner* — Bryon Gehman
(74) *Attorney, Agent, or Firm* — Larry L. Huston; Steven W. Miller

(57) ABSTRACT

A kit containing at least one cleaning article and a package therefor. The cleaning article has a layer of tow fibers and a layer of sheet material, joined together in a layered construction. The cleaning article is compressed as contained in the package and releases as dispensed to ambient pressure. Such release aids in fluffing of the cleaning article, improving cleaning performance.

13 Claims, 7 Drawing Sheets

(56) References Cited

U.S. PATENT DOCUMENTS

| | | | | |
|---|---|---|---|---|
| 7,228,587 | B2 | 6/2007 | Tanaka et al. | |
| 7,231,685 | B2 | 6/2007 | Tanaka et al. | |
| 7,234,193 | B2 | 6/2007 | Tanaka et al. | |
| 7,234,194 | B2 | 6/2007 | Tanaka et al. | |
| 7,237,296 | B2 | 7/2007 | Tanaka et al. | |
| 7,237,297 | B2 | 7/2007 | Tanaka et al. | |
| 7,243,391 | B2 | 7/2007 | Tanaka et al. | |
| 7,251,851 | B2 | 8/2007 | Lin et al. | |
| 7,302,729 | B2 | 12/2007 | Tanaka et al. | |
| 7,302,730 | B2 | 12/2007 | Tanaka et al. | |
| 7,334,287 | B2 | 2/2008 | Tanaka et al. | |
| 7,566,671 | B2 | 7/2009 | Hoadley et al. | |
| 7,712,578 | B2 | 5/2010 | Han | |
| 7,779,502 | B2 | 8/2010 | Fujiwara et al. | |
| 7,803,726 | B2 | 9/2010 | Policicchio et al. | |
| 7,937,797 | B2 | 5/2011 | Tsuchiya et al. | |
| 8,186,001 | B2 | 5/2012 | Tsuchiya et al. | |
| 8,245,349 | B2 | 8/2012 | Tsuchiya et al. | |
| 8,511,511 | B2 * | 8/2013 | Thoren | A47K 10/3818 221/26 |
| 8,893,345 | B2 * | 11/2014 | Cooper | A47L 13/20 15/209.1 |
| 2008/0032577 | A1 | 2/2008 | Policicchio et al. | |
| 2008/0135572 | A1 * | 6/2008 | Brennan | A47K 10/16 221/48 |
| 2010/0078444 | A1 * | 4/2010 | Shannon | B65D 83/0805 221/63 |
| 2010/0319152 | A1 | 12/2010 | Prizepasniak | |
| 2010/0608072 | | 12/2010 | Hood et al. | |
| 2013/0232706 | A1 | 9/2013 | Policicchio | |
| 2013/0232710 | A1 | 9/2013 | Policicchio | |
| 2013/0232711 | A1 | 9/2013 | Cooper | |
| 2013/0232714 | A1 | 9/2013 | Policicchio | |

* cited by examiner

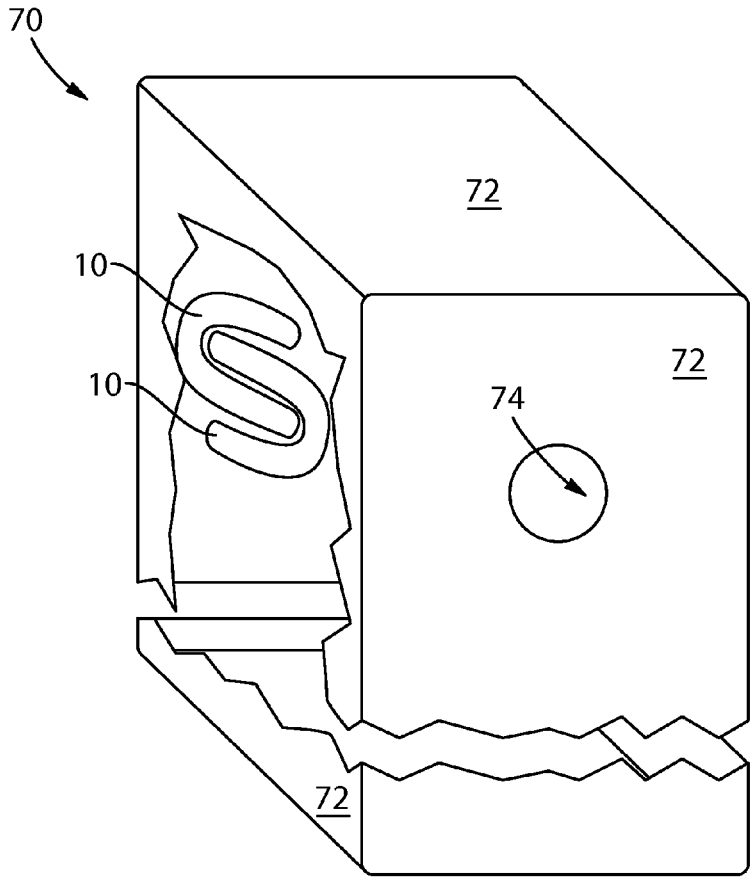
Fig. 2A
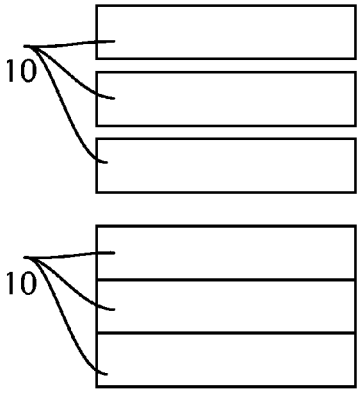
Fig. 2B1
Fig. 2B2
Fig. 3
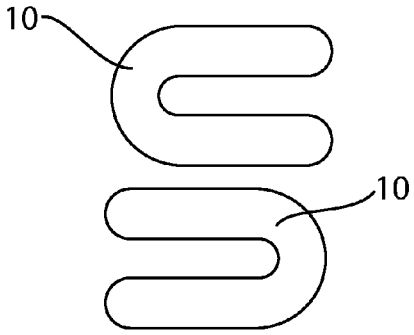

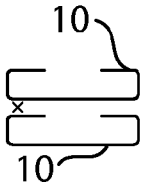
Fig. 5A
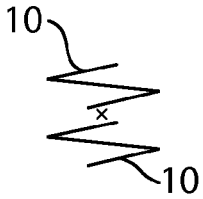
Fig. 5B
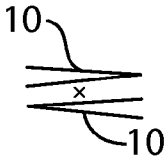
Fig. 5C
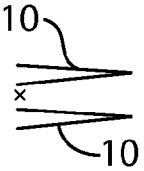
Fig. 5D
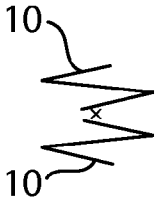
Fig. 5E
Fig. 6A
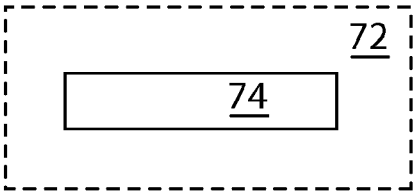
Fig. 6B
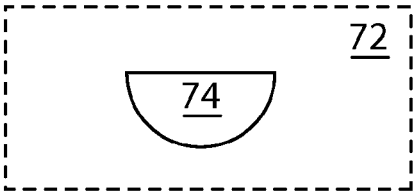
Fig. 6C
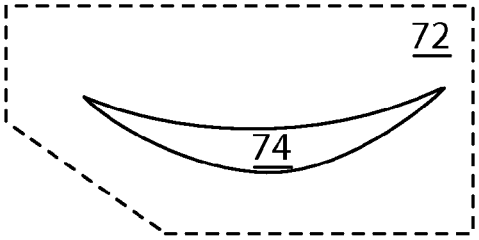
Fig. 6D
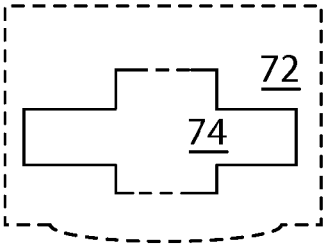
Fig. 6E
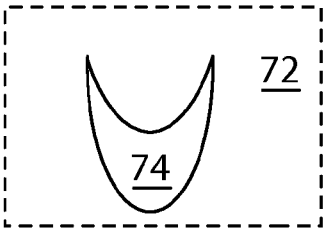
Fig. 6F
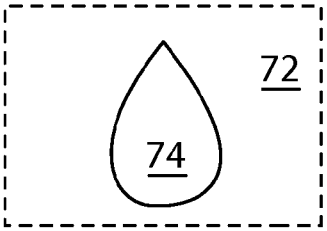
Fig. 6G
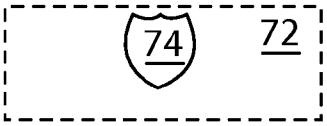

KIT FOR FLUFFING A CLEANING IMPLEMENT

FIELD OF THE INVENTION

The present invention relates to cleaning articles, more particularly to cleaning articles comprising tow fibers/non-woven sheets and more particularly to autogenous fluffing of such cleaning articles, typically referred to as dusters.

BACKGROUND OF THE INVENTION

Various cleaning articles have been created for dusting and light cleaning. For example, cloth rags and paper towels used dry or wetted with polishing and cleaning compositions have been used on relatively flat surfaces. But, rags and paper towels are problematic for reasons such as hygiene (the user's hand may touch chemicals, dirt or the surface during cleaning), reach (it may be difficult to insert the user's hand with the rag or paper towel into hard-to-reach places) and inconvenience (cleaning between closely-spaced articles typically requires moving the articles).

To overcome the problems associated with using rags and paper towels, various dust gathering devices having feathers, lamb's wool, and synthetic fiber brushes have been utilized for more than a century, as illustrated by U.S. Pat. No. 823,725 issued in 1906 to Hayden. Such dust gathering devices can be expensive to manufacture, and as such are designed to be cleaned and reused. One problem associated with a reusable dust gathering device is that such dust gathering devices may not hold or trap dust very well. Soiled, reusable devices are typically cleaned via shaking or through other mechanical agitation. This process is not entirely satisfactory as it requires an extra step during, interrupting and/or following the cleaning process. Furthermore, the attempted restoration of the device may not be successful, allowing redeposition of the previously collected dust.

To address the problems experienced with reusable dust gathering devices, disposable cleaning articles have been developed which have limited re-usability. The cleaning article may be used for one job (several square meters of surface) and discarded as being disposable, or may be restored and re-used for more jobs, then discarded. Traditional cleaning articles including feather dusters, cloths, string mops, strip mops and the like, are not disposable for purposes of this invention.

These disposable cleaning articles may include brush portions made of synthetic fiber bundles, called tow fibers, attached to a sheet as shown in Publication 2010/0319152. The tow fibers and sheets in such articles may be bonded together as disclosed in U.S. Pat. No. 7,712,578; U.S. Pat. No. 7,566,671; U.S. Pat. No. 7,779,502; U.S. Pat. No. 7,788,759; U.S. Pat. No. 7,937,797; U.S. Pat. No. 8,186,001 and U.S. Pat. No. 8,245,349. Or the tow fibers may be attached to a plate as shown in U.S. Pat. No. 4,145,787. The cleaning articles may be manufactured using the processes disclosed in U.S. Pat. Nos. 6,743,392 and/or 7,003,856.

Such cleaning articles may be made, for example, according to U.S. Pat. Nos. 6,813,801; 6,968,591; 6,984,615; 7,228,587; 7,231,685; 7,234,193; 7,234,914; 7,237,296; 7,237,297; 7,243,391; 7302729; 7,302,730; and/or 7,334,287 (having a common related application). The patents in this linage have a common feature—strips laterally extending from both sides of a generally planar article. U.S. Pat. No. 5,953,784 teaches strips extending not only from both sides of the article, but also from the front. Other geometries include U.S. Pat. No. 7,566,671 which does not use laterally extending strips but cleans only from one side of the implement and U.S. Pat. No. 7,251,851 which teaches a duster having a spiral configuration when disposed on the handle. Dusters which advantageously do not require gather strips are shown in commonly assigned publications: 2013/0232710A1, having differential overhang between the sheet and fibers; 2013/0232711A1, having a sheet with apertures; 2013/0232714A1, having an elastically contracted sheet; and 2013/0232706A1, having an elastically contracted upstanding panel, all filed Mar. 9, 2012. Optionally the cleaning article 10 may further comprise a non-planar structure, as disclosed in commonly assigned US publication 2011/0131746A1, filed Dec. 4, 2009 or wetting as disclosed in commonly assigned U.S. Pat. No. 7,803,726.

All such cleaning articles are typically packaged in a flat state. A plurality of these articles may be stacked together in a common cardboard box. Such stacking increases the planarity of these articles conserving packaging and handling costs, but potentially leading to diminished cleaning performance.

To get optimum performance, a user should pre-fluff the cleaning article prior to use. Fluffing, as defined herein, is the process of increasing the apparent volume of the cleaning article. The volume may be increased if the tow fibers and optionally any sheet layers extend out of the plane. In a particular embodiment, the tow fibers extend radially outwardly approximately 360 degrees from the longitudinal axis. A desirably fluffed cleaning article has no, or only minimal, apparent planarity.

For example, U.S. Pat. No. 8,151,402 teaches the importance of fluffing, but relies upon unusual and complex manufacturing to achieve the fluffing. But this attempt does not provide fluffing without extraneous steps by the manufacturer or user.

Even with instructions, many users simply do not correctly perform the fluffing step. Some users do not read the instructions and entirely skip this step. Fluffing can be frustrated if the gather strips are partially joined together due to improper cutting during manufacture, making the fluffing insufficient or more difficult. The user may tire of the fluffing steps and not fully complete this process. Accordingly, a system which fluffs but does not require extra steps by the user is needed.

Thus, there is a need for a cleaning article which does not require the user to perform a separate, but optional, fluffing step at the point of use. Such cleaning article may be fluffed during dispensing and provide ready-to-use performance without the need for a separate fluffing step.

SUMMARY OF THE INVENTION

The invention comprises a kit containing at least one duster type cleaning article, and packaging for containing and dispensing the cleaning article(s) therefrom.

BRIEF DESCRIPTION OF THE DRAWINGS

FIG. 2A is a broken perspective view of an exemplary package according to the according to the present invention shown partially in cutaway to reveal interleaved cleaning articles for pop up dispensing.

FIGS. 2B1 and 2B2 are schematic side elevational views of a stack of cleaning articles prior to compression and after compression, respectively.

FIG. 3 is a schematic side elevational view of non-interleaved cleaning articles folded about the transverse axes.

FIGS. 5A-5E are schematic side elevational views of various folded cleaning articles which are adjacent and not interleaved.

FIGS. 6A-6G are frontal views of various shapes of dispensing apertures suitable for use with the present invention, any of which such apertures may wrap two or more contiguous sides of a dispensing package.

DETAILED DESCRIPTION OF THE INVENTION

Figure 1A:
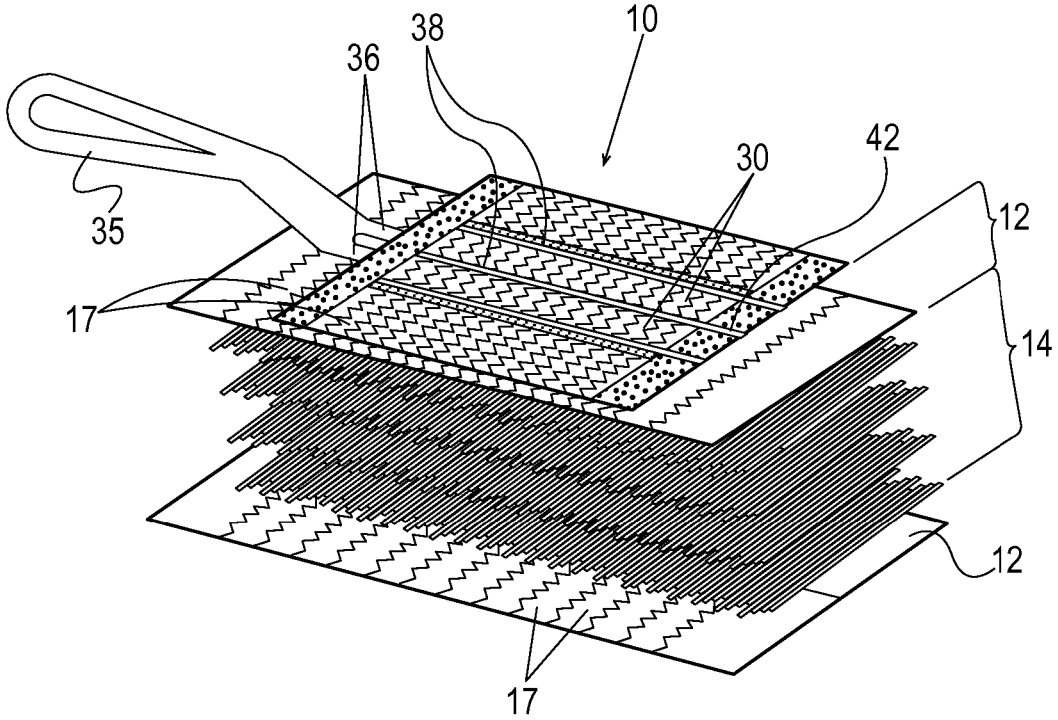
PRIOR ART Fig. 1A
FIG. 1A is a schematic exploded perspective view of a cleaning article according to the prior art and having strips on two outer laminae.
Figure 1B:
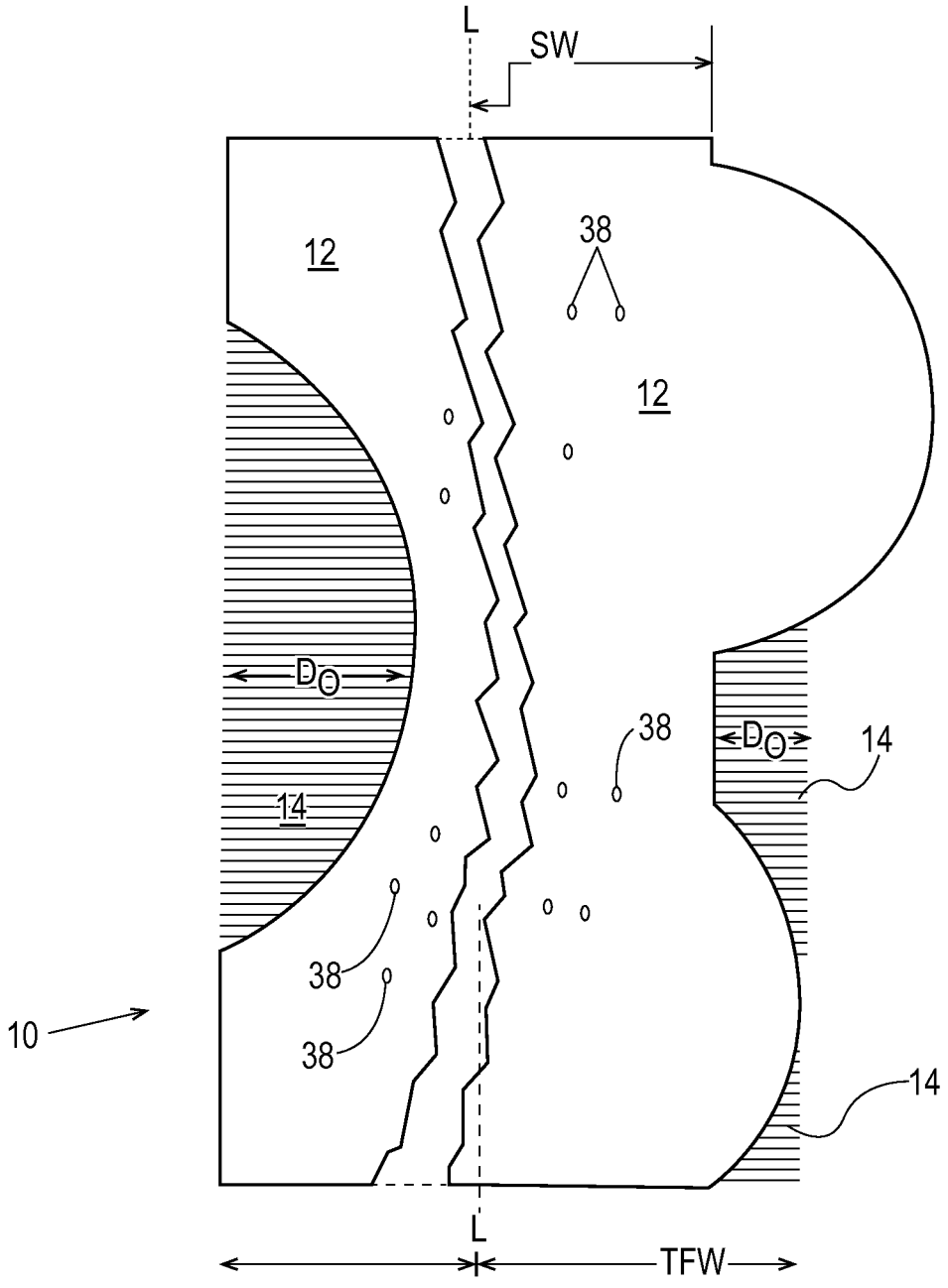
FIG. 1B is a broken schematic top plan view of a cleaning article according to the prior art and having a sheet with a concave notch on one side of the longitudinal axis L and having convex shapes on the other side of the longitudinal axis L.
Figure 4A:
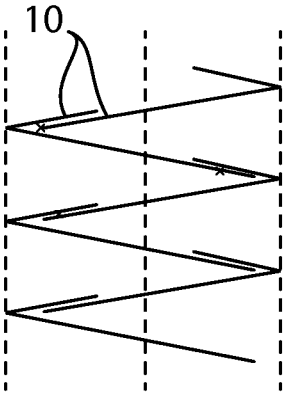
FIGS. 4A-4E are schematic side elevational views of various interleaved cleaning articles.
Figure 4B:
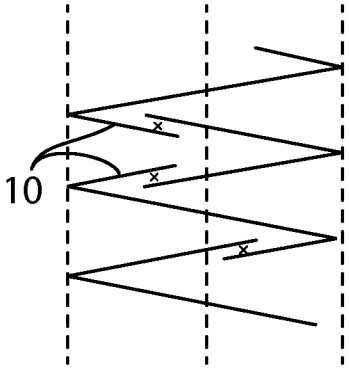
Figure 4C:
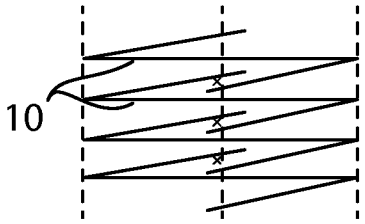
Figure 4D:
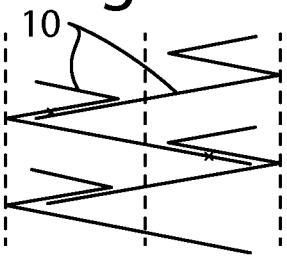
Figure 4E:
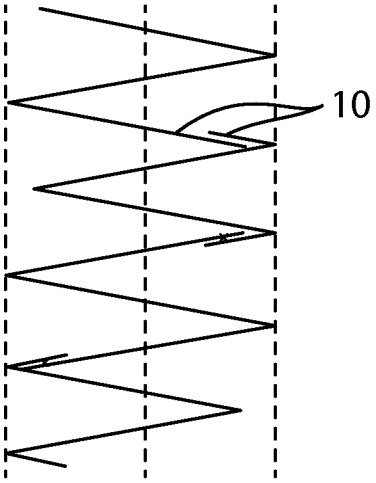

Referring to FIGS. 1A and 1B, the cleaning article 10 may be generally elongate, having a longitudinal axis L, although other shapes are contemplated and feasible. These cleaning articles 10 are typically referred to as dusters. The cleaning article 10 may be removably attachable to a handle 35 and/or may be used without a handle 35. A suitable handle 35 is disclosed in commonly assigned U.S. Pat. No. 8,578,564. Cleaning articles 10 having a pocket for receiving the handle 35 are shown in U.S. Pat. No. 7,650,664; U.S. Pat. No. 7,827,650 and 20130340191.

The z-direction of the cleaning article 10 is the direction perpendicular to the sheet 12 which is typically closest to the handle 35 (if present) of the cleaning article 10, the XY plane is defined as the plane defined by the sheet 12 and is typically perpendicular to the z-direction. The cleaning article 10 may have a longitudinal axis L and a transverse axis T orthogonal thereto. The cleaning article 10, and respective components thereof, may have two longitudinal edges 20 parallel to the longitudinal axis L and two transverse edges 22 parallel to the transverse axis T.

The length of the cleaning article 10, etc. is taken in the longitudinal direction. The width of the cleaning article 10 corresponds to the transverse direction perpendicular to the length direction and disposed within the plane of the sheet 12. The thickness is defined as the dimension in the z-direction. The length and width of the strips shown in the art are taken in the transverse and longitudinal directions, respectively.

The cleaning article 10 may be thought of as having two, three or more laminae joined in face-to-face relationship. The laminae may comprise a tow fiber lamina 14, intermediate two laminae of generally planar sheets 12. Alternatively, a single tow fiber layer 14 may be joined to a single generally planar sheet 12. The tow fiber layer 14 is shown to comprise four layers, although one of skill will understand from one to several layers are feasible and contemplated for use with the present invention. Likewise, one, two, three or more sheets 12 are feasible and contemplated for use with the present invention. As used herein, a cleaning article 10 comprising a laminate of at least one tow fiber lamina 14 and at least one sheet 12 and usable to collect dust from a surface is referred to as a duster. It is to be recognized that the duster may be fluffed into various configurations, including non-flat, generally cylindrical, etc.

Referring particularly to FIG. 1A the cleaning article 10 may optionally further comprise gather strips 17, as known from the prior art. As used herein, gather strips 17 refer to cantilevered elements extending transversely outwardly from the longitudinal centerline of the article 10, and having a length (taken in the transverse direction) greater than the corresponding width (as taken in the longitudinal direction). The gather strips 17 lie within the XY plane as intended by manufacture, although may be deformed out of the XY plane due to fluffing before use, and/or deformations which occur in use due to movement against the target surface. The gather strips 17 may be incorporated into one of the sheets 12 described above or may be deployed on a separate sheet 12. The gather strips 17 may be incorporated on an outermost portion of the tow fiber bundle 14, may be incorporated between tow fiber bundle layers 14 and/or combinations thereof.

Referring particularly to FIG. 1B, if desired, each longitudinal edge of either and/or more sheets 12 may be notched to be concave. This arrangement provides the advantage that the relatively greater differential overhang near the center of the cleaning article 10 may provide relatively greater fluffing of the tow fibers near the center of the cleaning article 10. Or the sheet 12 may be convex as shown.

An attachment system may provide for removable attachment of the cleaning article 10 to a suitable and optional handle 35. The cleaning article 10 attachment system and optional complementary handle 35 attachment may comprise adhesive joining, cohesive joining, mechanical engagement, etc. One common attachment system comprises sleeves 30 into which the tines 36 of the handle 35 may be inserted. The sleeves 30 may be disposed on an outer lamina 12.

Referring to FIGS. 1A and 1B, the sheet 12 may have an outwardly facing preferential cleaning side and a second inwardly facing attachment side opposed thereto. The sheet 12 may comprise a nonwoven sheet 12. Suitable nonwovens may be made according to commonly assigned U.S. Pat. Nos. 6,797,357; 6,936,330, D489,537 and/or D499,887.

Adjacent the sheet 12 may be a compressible and/or deformable second lamina of fibers 14. The second lamina may comprise tow fibers 14. The tow fiber lamina 14 may be joined to the sheet 12 in face-to-face relationship. The tow fiber lamina 14 may be suitable for directly contacting the target surface during cleaning.

The tow fibers 14 may be synthetic. As used herein "bundle fibers" and/or "tow" refer to fibers comprising synthetic polymers including polyester, polypropylene, polyethylene, bio-derived polymers such as polylactic acid, bio-polyethylene, bio-polyester and the like. Tow fibers 14 also include fibers from natural sources such as cellulose, cellulose acetate, flax, hemp, jute and mixtures thereof manufactured wherein the individual fibers are relatively long strands manufactured in bundles. The bundle fibers may be defined as any fibers having distinct end points and at least about 1 cm in length. The cleaning article 10 of the present invention may further comprise an optional absorbent core (not shown).

The sheet 12, fibrous layer 14 and non-planar structure 16 may be joined together by thermal bonding, autogenous bonding, ultrasonic bonding, heat sealing, adhesive and/or other means known in the art. The sheet 12 may comprise two plies, joined together in face-to-face relationship. The sheet 12, fibrous layer 14 and non-planar structure may be bonded in a pattern which provides a central spine parallel the longitudinal axis L.

The joining of the tow fiber layer 14 and generally planar sheets 12 may be done with any combination of continuous bonds 38 and/or spot bonds 38, as known in the art. The bonds 38 may be used to create sleeves for an attachment system as known in the art and discussed herein.

The bonding pattern joining the two plies may be provided in a pattern which provides a sleeve 30 complementary to and able to receive the tines 36 of the handle 35, if used with the cleaning article 10 of the present invention. Particularly, the bonding may be provided in a pattern which is generally longitudinally oriented, so that the tines 36 may be inserted into the sleeve 30 created between adjacent bonds 38.

The bond pattern may provide a continuously bonded or discretely bonded central spine 42. Outboard of the central spine, the bond pattern may comprise one or more continuous or discontinuous bond sites. The space between the central spine bond and the outboard bonds 38 may create a sleeve 30 for receiving a tine 36 of the optional handle 35. If desired, the sheet 12 may be shrunk/strained in the cross-direction. This process can provide rugosities or wrinkles in sheet 12. The rugosities/wrinkles space apart the plies of sheet 12, allowing for easier insertion of the tines 36 into the sleeve 30, if so desired.

If desired, the various cleaning articles 10 described herein may be packaged and sold in a kit. Some of the cleaning articles 10 may have the aforementioned concave sheet 12 and other cleaning articles 10 may have a convex sheet 12. This arrangement provides the benefit that the user has a choice of different cleaning articles 10 for different tasks.

One of skill will recognize that hybrids and combinations of the embodiments described above are contemplated and feasible. For example, a single cleaning article 10 may comprise plural sheets 12 having like or different geometries and/or plural tow fiber layers 14 having like or different geometries. Such sheets 12 and tow fiber layers 14 may be disposed next to each other, interspersed or placed in any desired configuration of layers.

Any of the sheet 12 and/or layer of tow fibers 14 may be completely or partially coated with adhesive, wax, Newtonian or non-Newtonian oils or a combination thereof, in order to improve cleaning and increase retention of absorbed debris. If desired, the cleaning article 10 may optionally be used with a cleaning solution or other solution usable for other purposes such as treating the surface for appearance or disinfectant, etc. The cleaning solution may be pre-applied to the cleaning article 10, creating a pre-moistened cleaning article 10 or may be contained within a separate reservoir for dosing onto the cleaning article 10 and/or target surface. The cleaning solution may comprise a majority water, and at least about 0.5, 2, 5 or 10% solids, or at least about 30% or 50% aqueous solvents, non-aqueous solutions or mixtures thereof (all by weight).

Referring to FIGS. 2A-3, the cleaning article(s) 10 of the present invention may be stored, transported and/or sold in a package. The package 70 may prevent undesired intrusion of dirt, allow for stacking and provide billboard effect on the store shelf. The package 70 may be a common parallelepiped, as shown or may be of any other suitable shape and geometry.

The package 70 may have one or more discernible sidewalls 72. The package may have a dispensing aperture 74, which may be disposed in one or more of the sidewalls 72. The aperture 74 may be disposed in a single sidewall 72 or intercept two or more contiguous sidewalls 74 as desired. The cleaning articles 10 are dispensed from inside the package 70, through the aperture 74 for use as desired. One of skill will understand that the aperture 74 may be disposed on the top, left/right, front, bottom or back sidewall 72 or any contiguous combination thereof. For convenience, the sidewall 72 of the package 70 having the predominant or largest area of the aperture 74 is referred to as the dispensing sidewall 72. It is to be understood that the aperture 74 may have a cover 78 as sold, which cover 78 is later optionally or selectively removed by the user, yet still comprise an aperture 74 as sold.

The package 70 may be made of ordinary carton board, as is well known in the art. The package 70 may be coated with wax or with other impervious coatings, to prevent permeation of wax or oil from the cleaning article through the carton board. Alternatively the package 70 may be made of common plastic film, such as PE or LDPE, hard plastic material, or any other suitable material.

The package 70 may have an interior package 70 volume. The interior package 70 volume may be ascertained by simple geometry or other known means, such as using CAD software. The cleaning articles 10 likewise have a cleaning product 10 volume. The cleaning product 10 volume may be generally determined by multiplying length×width×height under a nominal 5 gram load applied perpendicular to the plane of the cleaning article 10 as set forth below.

A single cleaning article 10, plurality of cleaning articles 10, and in a particular case a stack of cleaning articles 10, may be provided and have a predetermined stack height. These one or more cleaning articles 10 may be provided with a package 70 to form a kit comprising the cleaning article(s) 10 and package 70 therefor. Such package 70 may have an interior dimension which is less than the stack height. Such interior dimension is referred to as the package 70 height.

The package 70 height may be 30 to 70 or 40 to 60 and particularly about 50 percent less than the stack height of the cleaning articles 10 sold therein. It is prophetically believed that a package 70 height providing a linear compression of 30 to 70 or 40 to 60 and particularly about 50 percent provides for adequate rebound of the cleaning article 10, to minimize the fluffing required by the user at the point of use. Less compression is prophetically believed to be insufficient to restore a cleaning article 10 fluffed prior to insertion into the package 70 to a fluffed condition. If the package 70 is made of a flexible film, such as PET, compression less than 30 or 40% may be insufficient to prevent an irregular package 70 shape. The irregular package 70 shape makes it difficult to stack package 70 on the shelf.

Greater compression is prophetically believed to cause plastic deformation of the tow fiber lamina(e) 14, preventing full rebound of the cleaning article 10 to a fluffed condition following removal from the package 70. If the package 70 is made of a flexible film, such as PET, compression greater than 60% or 70% may cause tearing of the film.

The package 70 height may be measured using an ordinary scale as sold by the Starrett Corporation of MA. If the package 70 height is not constant, the height at the portion of the package 70 having the dispensing aperture 74 is considered. The stack height is determined as the free height of the cleaning articles 10 as set forth below. The stack height can be determined after the cleaning articles 10 are removed from the box and equilibrated for 24 hours as set forth below.

Manufacture and/or insertion of the cleaning articles 10 into the package 70 results in compression of the cleaning articles 10, due to the difference between the stack height and the package 70 height. Likewise, the cleaning article(s) 10 may likewise have a cleaning article 10 volume which is greater than the interior package 70 volume. The cleaning articles 10 may be compressed to 30 to 70 or 40 to 60 and particularly about 50 percent of the original volume upon being disposed in the package 70. Alternatively or additionally, if the package 70 is made of film or other appropriate material, compression of the cleaning articles 10 may be accomplished through vacuum packing, as is known in the art.

Figure 8A:
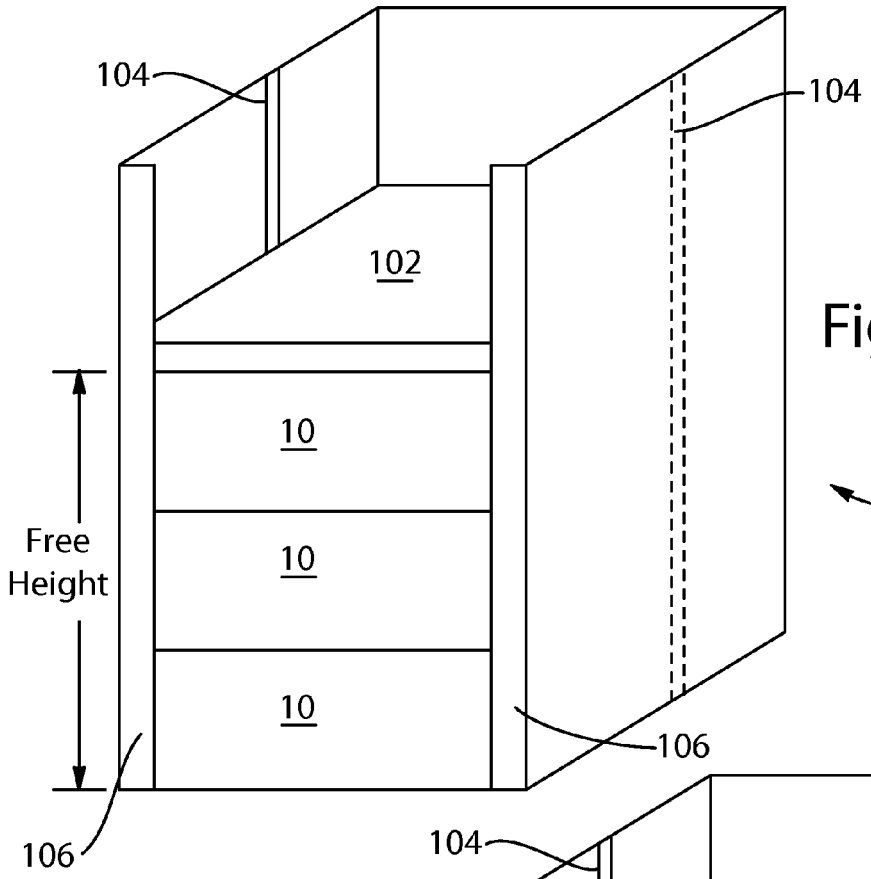
FIG. 8A is a schematic perspective view of an apparatus usable to test linear compression of cleaning articles according to the present invention, showing three articles in an uncompressed state.
Figure 8B:
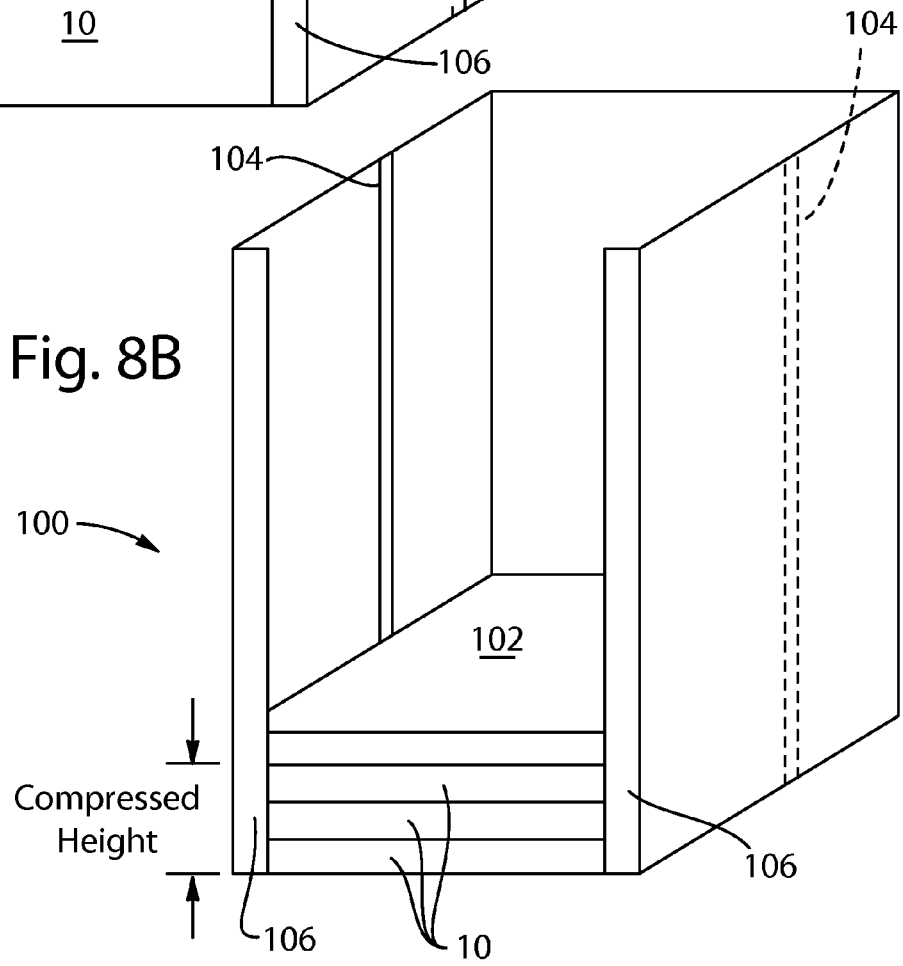
FIG. 8B is a schematic perspective view of the apparatus of FIG. 8A, showing the three articles in a compressed state.

Referring to FIGS. 8A-8B, the percentage of linear compression may be measured using a common type of apparatus 100 known for this purpose. The apparatus 100 may have four rigid walls, and have an interior floor sized to closely match the footprint of the cleaning article 10 under consideration. The apparatus 100 may further comprise weights 102, each weight 102 having a footprint likewise closely matching that of the cleaning article 10 under consideration. The apparatus 100 may further provide one or more optional guides 104 to assist in the linear and even travel of the weight 102, as it compresses the cleaning article(s) 100.

One or more scales 106 may be provided on the apparatus to measure the height of the cleaning articles 10. The scale(s) 106 may be provided with ordinary markings to m make the height measurements. The heights of the cleaning article(s) 10 are measured between the top of the floor and bottom of the appropriate weight 102. If the cleaning articles 10 do not uniformly compress, the height is measured at the center of the cleaning article(s) 10.

At least two rigid weights 102 are provided. The weights 102 may be sized to have a foot print slightly smaller than that of the apparatus 100 and which closely approximates that of the cleaning article(s) 10. For example, the footprint of the weights 102 may be 11.5 cm×16 cm to approximate the footprint of the cleaning article 10. The weights 102 must move freely in the apparatus 102, without binding or restriction. The weights 102 may have a shape complementary to the optional guides 104, so that the weights 102 each travel on the guides 104 in a manner as close as reasonably possible to being rectilinear with the face of each weight 102 being perpendicular to the compression direction.

The first weight 102 to be used weighs 5.0±0.1 grams. This weight 102 is used to establish a free, or uncompressed, height. The second weight 102 to be used weighs 100.0±0.1 grams. This weight 102 is used to establish a compressed height.

To measure the compression of the cleaning articles 10, the articles are equilibrated at 20±1 degrees Celsius and 50±5% relative humidity for 24 hours. A number of cleaning articles 10, comparable to the number sold in a particular package 70, is selected. The cleaning articles 10 are tested in an a flat state.

The cleaning articles 10 are placed in the apparatus 100. The first weight 102 of nominally 5 grams is placed on top of the stack of cleaning article(s) 10 and a free height is measured using the scales 106 three seconds after the first weight 102 is applied. The first weight 102 is removed. The second weight 102 of nominally 100 grams is immediately placed on top of the stack of cleaning article(s) 10 and a compressed height is measured using the scales 106 three seconds after the second weight 102 is applied.

The percentage compression is then determined as:

$$\{(\text{Free Height}-\text{Compressed Height})/(\text{Free Height})\}*100.$$

Referring to FIG. 3, the cleaning articles 10 may be folded about either the longitudinal axis, transverse axis, or any other suitable fold line. Upon removal from the package 70, the cleaning article 10 may be unfolded providing the benefit of allowing the cleaning article 10 to spring back into a more fluffed state. Furthermore it is believed that such folding of adjacent cleaning articles 10 minimizes chaining, reducing or even preventing premature dispensing of the successive cleaning article 10.

Conversely, and referring to FIGS. 4A-4E, popup dispensing may be desired. If so successive cleaning articles 10 may be interfolded using any of the fold patterns illustrated. This arrangement provides the advantage that after the first cleaning article 10 is dispensed, the next cleaning article 10 is visible, available and ready for use.

Referring to FIGS. 5A-5E, if desired, the cleaning articles 10 needed not be interfolded. Instead the cleaning articles 10 may be folded with various adjacencies. This arrangement allows for differential compression of various portions of the cleaning articles 10. This arrangement provides the unpredicted advantage that differential fluffing occurs upon dispensing of the cleaning articles 10 from the package 70. Such differential fluffing provides the benefit that different portions of the cleaning article 10 will reach into different areas to be cleaned, prophetically resulting in improved cleaning performance.

Referring to back to FIG. 2A, the package 70 may have a dispensing aperture 74. The dispensing aperture 74 may have a cross section smaller than the cross section of the cleaning article 10 immediately prior to being dispensed therethrough. Upon removal of the cleaning article 10 from the package 70 through the dispensing aperture 74, the cleaning article 10 is constricted, then rebounds as the cleaning article 10 is no longer constrained by the cross section of the dispensing aperture 74.

Referring to FIGS. 6A-6G, various cross sections of the dispensing aperture 74 may be utilized. The dispensing aperture 74 may constrict the cleaning articles 10 in the width direction, the height direction or both. Or the dispensing aperture 74 may selectively deform the cleaning articles, as occurs with a crescent shaped or wavy shaped dispensing aperture 74. It is prophetically believed that such selective constriction of the cleaning article 10, autogenously during dispensing, improves fluffing by the differential deformation of the tow fiber laminae 14.

It is believe that such constriction/rebound increases fluffing of the cleaning article 10. This process provides the benefit that without optional additional fluffing steps, the cleaning article 10 is fluffed immediately prior to and at the point of use. A package 70 and dispensing aperture 74 may be made according to the teachings of commonly assigned US 2007/0215629, published Sep. 20, 2007; US 2008/0105699 published May 8, 2008; U.S. Pat. No. 4,623,074 or U.S. Pat. No. 5,516,001.

Figure 7A:
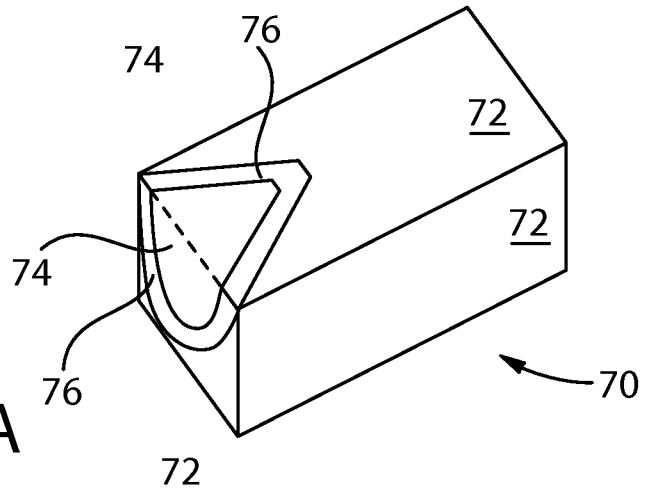
FIG. 7A is a perspective view of an alternative embodiment of a system according to the present invention having an external dispensing panel.
Figure 7B:
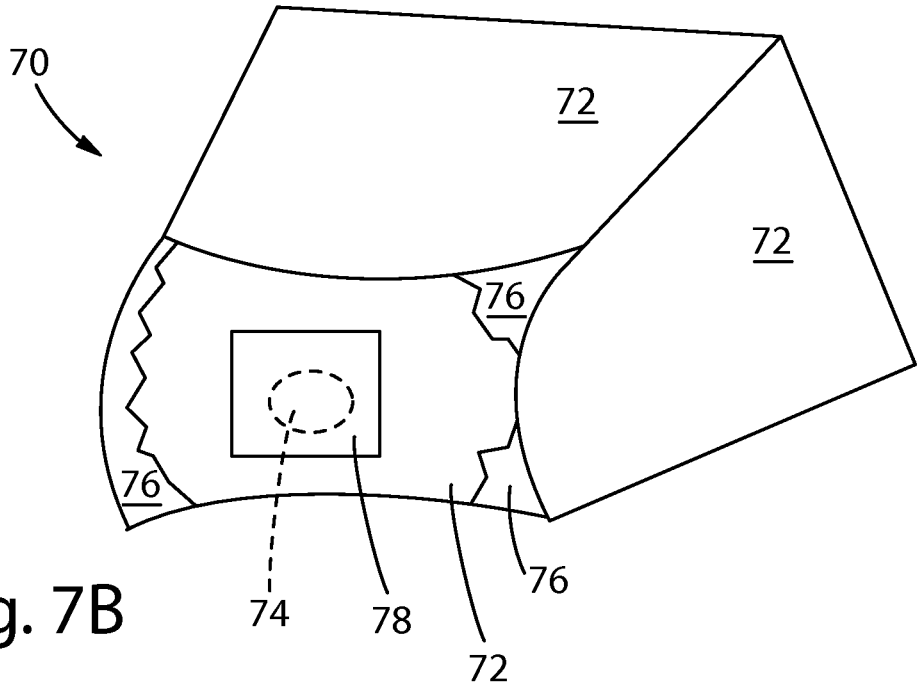
FIG. 7B is a perspective view, shown partially in cutaway, of an alternative system according to the present invention having a convex outward dispensing wall, internal dispensing panel and cover over the aperture.

Referring to FIGS. 7A-7B, the package 70 may be made of a plastic film or other flaccid material. If so, the dispensing sidewall 72 may be reinforced with a dispensing panel 76. The dispensing panel 76 may be generally rigid. As used herein, a flaccid sidewall 72 deforms under ordinary dispensing and use conditions and does not fully constrict or extrude the cleaning article 10 as desired during extrusion through the dispensing aperture 74. As used herein, a rigid dispensing panel 76 generally does not deform under ordinary dispensing and use conditions and does improves how the cleaning article 10 is constricted during extrusion through the dispensing aperture 74.

By extrusion it is meant that the cleaning article 10 is constricted in at least a portion, if not all, of its cross section during dispensing through the aperture 74. As used herein, deformation is considered in the dispensing direction, which dispensing direction is generally perpendicular to the plane of the dispensing sidewall 72, dispensing aperture 74 and dispensing panel 76. The aperture 74 is considered to be smaller than the cleaning article 10 if the aperture is smaller in any dimension within the sidewall 72 and generally perpendicular to the dispensing direction. By having any such smaller dimension, it is believed that the aperture will constrict the cleaning article as it is dispensed therethrough. If the edge of the aperture 74 has minor asperities, it is prophetically believed friction against the asperities may improve fluffing.

The rigid dispensing panel 76 may be made of cartonboard, rigid plastic material or other material which resists deformation perpendicular to the plane of the dispensing panel 76. The dispensing panel 76 has an aperture 74 for dispensing the cleaning articles from the package 70.

Referring particularly to FIG. 7B, the dispensing panel 76 may be generally the same size, shape and geometry as the dispensing sidewall 72. This arrangement provides for convenient assembly of the components and increases package 70 shape retention. If desired in an exemplary parallelepipedal package 70, the dispensing panel 76 may have one, two, three or four tabs. The tabs may extend in the direction of, and parallel to, sidewalls 72 contiguous and generally perpendicular to the dispensing sidewall 72. The tabs may provide for maintaining the location of the dispensing panel 76 in the package 70.

The package 70 may have sidewalls 72 which are not mutually perpendicular/parallel. Instead, if desired, the sidewalls 72 may converge towards the dispensing sidewall 72 having the aperture 74. This arrangement provides the benefit of beginning to compress or pre-fluff the cleaning article prior to extrusion through the aperture 74.

If desired, the dispensing sidewall 72, and associated dispensing panel 76, may be curvilinear. For example, the dispensing sidewall 72, and associated dispensing panel 76, may be oriented convex outwardly. This arrangement provides the benefit that the convex dispensing sidewall 72 and associated dispensing panel 76 provide a funnel or funneling effect as the cleaning article 10 approaches, and is dispensed through the aperture 74.

The dispensing panel 76 and aperture 74 may provide for reach-in to pop up dispensing. This arrangement provides for the user to reach his/her fingers into the package 70 to retrieve the first cleaning article 10 through the aperture 74. Successive cleaning articles 10 may encounter a greater constriction or smaller portion of the aperture 74, to prevent chaining. The cleaning articles 10 may be extruded upon removal through the aperture 74 so that each cleaning article 10 is constricted/then rebounds upon removal from the package 70.

The rigid dispensing panel 76 may have a second aperture 74 therethrough for dispensing of the cleaning articles 10 through the first aperture in the sidewall 72. The first aperture 74 and second aperture 74 may be of identical size, shape, and alignment on the dispensing wall. Alternatively, the first aperture 74 and second aperture 74 may be of mutually different size or shape, to provide for differential fluffing of the cleaning article 10 as it is extruded therethrough.

The present system may have, but does not rely upon, an aperture 74 having a larger area for reach in and a smaller area for pop up, as is known in the art. The present system may have a less complex aperture 74 which provides a common opening which can accommodate both the fingers of the user and provide for constriction/rebound of the cross section of the cleaning article 10 upon removal therethrough.

The aperture 74 may be further provided with an optional cover 78 as is known in the art. The cover 78 minimizes intrusion of dust and debris into the package 70. The aperture 74 need not be sealed, as the cleaning articles 10 are generally used dry. If pre-wetted cleaning articles 10 are used, the aperture 74 may be hermetically sealed and sealable by the cover 78 as is known in the art. The cover 78 may be hinged, adhesively sealed, have a snap fit, etc. comprise a portion of the sidewall 72 joined by a line of weakness such as perforations, as are known in the art.

Referring particularly to FIG. 7A, alternatively, the dispensing panel 76 may be smaller than the dispensing sidewall 70. If desired such a dispensing panel 76 may be congruent the dispensing aperture 74 to concentrate reinforcement of the rigidity in the dispensing direction and perpendicular to dispensing panel 76 at the aperture 74. This arrangement provides the benefit of material savings. Of course, any sidewall 72, such as the dispensing sidewall 72 need not be flat as shown.

The dispensing panel 76 may be joined to the inside or outside of the dispensing sidewall 74. Disposing the dispensing panel 76 inside the package 70 provides the benefit that the package graphics look more uniform and may provide a larger billboard effect. Also the dispensing panel 76 is less likely to become dislodged during shipping and handling. Disposing the dispensing panel 76 on the outside of the package 70 provides the benefit that potential tearing of the cleaning article 10 is reduced. Adhesive joining may be used as is known in the art, or the dispensing sidewall 72 and associated dispensing panel 76 may be thermally bonded if the materials are compatible.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A kit comprising a package and at least one cleaning article therein, each said at least one cleaning article comprising tow fibers and at least one nonwoven sheet joined thereto to form a respective laminate duster, each said at least one cleaning article having a cleaning article cross section, said at least one cleaning article being compressed about 30 to about 70 percent in said package, said package having a dispensing aperture therethrough, said dispensing aperture having a dispensing aperture cross section smaller than said cleaning article cross section whereby upon removal of each said at least one cleaning article from said package through said dispensing aperture, each said at least one cleaning article is constricted in cross section, then rebounds as each said respective at least one said cleaning article is no longer constrained by said dispensing aperture cross section so that said tow fibers of each said respective at least one cleaning article are fluffed by dispensing through said aperture.

2. A kit according to claim 1 wherein said package has at least one sidewall with a dispensing aperture therethrough, and comprising a plurality of cleaning articles therein, said package having a package height taken perpendicular to said aperture, said plurality of cleaning articles having a stack height providing for compression of said cleaning article and taken in the same direction as said package height, said compression being in the same direction as said package height and said stack height.

3. A kit according to claim 2 wherein said plurality of cleaning articles is compressed about 40 to about 60 percent in said same direction.

4. A kit according to claim 2 wherein said cleaning articles are folded in said package.

5. A kit according to claim 4 wherein said cleaning articles are interfolded to provide pop up dispensing.

6. A kit comprising a package and at least one cleaning article therein, each said at least one cleaning article having a respective cleaning article cross section and comprising tow fibers and at least one nonwoven sheet joined thereto to form a respective laminate duster, said package comprising a dispensing sidewall having a dispensing aperture therethrough, said dispensing aperture having a size which constricts each said at least one at least one cleaning article upon removal therethrough, said dispensing aperture having a dispensing aperture cross section smaller than each said at least one cleaning article cross section whereby upon removal of each said at least one cleaning article from said package through said dispensing aperture, each said at least one cleaning article is constricted in cross section, then rebounds as each said respective at least one cleaning article is no longer constrained by said dispensing aperture cross section so that said tow fibers of each said respective at least one cleaning article are fluffed by dispensing through said aperture.

7. A kit according to claim 6 comprising a plurality of cleaning articles therein, said plurality of cleaning articles being interfolded to provide pop-up dispensing.

8. A kit according to claim 7 wherein said cleaning articles are bi-folded.

9. A kit according to claim 6 wherein said at least one cleaning articles is bi-folded.

10. A kit according to claim 9 comprising a plurality of cleaning articles, wherein said cleaning articles are compressed 30 to 70%.

11. A kit according to claim 10 wherein said cleaning articles are selectively constricted upon removal through said aperture, such that only a portion of each said cleaning article is equally constricted upon dispensing.

12. A kit according to claim 10 wherein said cleaning articles are compressed 40 to 60%.

13. A kit according to claim 6 wherein said package is generally parallelepipedally shaped having six sidewalls, and said dispensing aperture intercepts two contiguous sidewalls.

* * * * *